US007662046B2

(12) United States Patent
Yu

(10) Patent No.: US 7,662,046 B2
(45) Date of Patent: Feb. 16, 2010

(54) CLAMPING FIXTURE FOR BOUNCING APPARATUS

(76) Inventor: Chun-Shen Yu, 5F, No. 1-32, Kuojian Rd., Qianzhen Dist., Kaohsiung City (TW)

( * ) Notice: Subject to any disclaimer, the term of this patent is extended or adjusted under 35 U.S.C. 154(b) by 395 days.

(21) Appl. No.: 11/699,012

(22) Filed: Jan. 29, 2007

(65) Prior Publication Data

US 2008/0179878 A1 Jul. 31, 2008

(51) Int. Cl.
*A63G 23/00* (2006.01)
*A63B 25/08* (2006.01)

(52) U.S. Cl. ..... 472/135; 482/77; 482/121

(58) Field of Classification Search ..... 472/135, 472/137; 446/486; 482/75–77, 26, 121, 482/123, 127, 128, 133, 148; 280/87.05
See application file for complete search history.

(56) References Cited

U.S. PATENT DOCUMENTS 4,902,004 A * 2/1990 Gerlach ..... 482/77
6,352,494 B2 * 3/2002 McAlonan ..... 482/77
6,390,956 B1 * 5/2002 Seelye et al. ..... 482/77
6,503,177 B2 * 1/2003 Herman ..... 482/77
6,558,265 B1 5/2003 Middleton et al.
6,716,108 B1 4/2004 Middleton et al.
6,827,673 B2 * 12/2004 Chen et al. ..... 482/77
7,011,608 B2 * 3/2006 Spencer ..... 482/77
7,108,640 B2 * 9/2006 Emmert ..... 482/75
7,381,165 B2 * 6/2008 Arginsky et al. ..... 482/77

* cited by examiner

*Primary Examiner*—Kien T Nguyen
(74) *Attorney, Agent, or Firm*—Muncy, Geissler, Olds & Lowe, PLLC

(57) ABSTRACT

An improved clamping fixture for bouncing apparatus to clamp two ends of a resilient stem of a bouncing apparatus includes two coupling members and two anchor members. The two coupling members are made from plastics and have respectively a first latch member and a second latch member to form a clamping space, and anchor bosses on two outer sides pivotally engageable with the anchor members. The two coupling members have coupling forces to clamp the two ends of the resilient stem, and the two anchor members are coupled on the upper end and lower end of the bouncing apparatus. The resilient stem can be positioned securely at two ends of the bouncing apparatus to facilitate bouncing operation without being scraped, damaged or fractured. Durability is greater.

5 Claims, 7 Drawing Sheets

CLAMPING FIXTURE FOR BOUNCING APPARATUS

FIELD OF THE INVENTION

The present invention relates to a clamping fixture for bouncing apparatus and particularly to a clamping fixture to quickly clamp two ends of a resilient stem of a bouncing apparatus without escaping or fracturing when the bouncing apparatus is under a strong bouncing condition.

BACKGROUND OF THE INVENTION

A conventional bouncing apparatus usually has a clamping fixture to clamp two ends of a resilient stem 10 or 20 made from rubber (referring to U.S. Pat. Nos. 6,716,108 and 6,558,265 as shown in FIG. 1. The clamping fixture has two mating coupling members 11 and 11*a* and two anchor members 13 and 13*a*. The coupling members 11 and 11*a* have struts 110, a fastening hole 1100, a cavity 110*a* and a fastening hole 1100*a* on an inner side opposing each other. They aim to couple two ends of the resilient stem 10 and are fastened through fastening elements 12. The coupling member 11*a* further has a plurality of stubs 111 on an outer side corresponding to and engageable with coupling apertures 132 and 132*a* formed on coupling ends 131 and 131*a* of the two anchor member 13 and 13*a*. Such a structure is complex and difficult to fabricate and assemble. When in use for bouncing under a strong force, the coupling structure between the coupling apertures 132 and 132*a* formed on coupling ends 131 and 131*a* of the two anchor members 13 and 13*a* and the stubs 111 easily breaks away due to not latching means (referring to FIG. 2). Hence the resilient means has risk concern when in use. To use it on the bouncing apparatus creates a great safety issue.

As the resilient means shown in FIG. 1 is not desirable for fabrication and use, another clamping fixture made of aluminum that has two corresponding coupling members 21 and anchor members 22 has been developed to clamp two ends of the resilient stem 20 (referring to FIG. 3). The two coupling members 21 are made of metal and have a sharp latching inner rim 211. When the two ends of the resilient stem 20 are clamped, the coupling members 21 tend to scrape and damage the resilient stem 20 or even create fracture (referring to FIG. 4). Moreover, the coupling members 21 have respectively an indented portion 212 to be latched by a boss 221 formed on the anchor member 22. Referring to FIG. 3, when the resilient means of the bouncing apparatus is in use under a strong bouncing, as the boss 221 and indented portion 212 are coupled without latching. The boss 221 easily breaks away from the indented portion 212 and results in separating of the anchor member 22 and the coupling member 21. Hence it is also not desirable design.

Therefore there is a need to provide an improved clamping fixture for bouncing apparatus to provide rapid clamping without scraping or damaging the resilient stem, and form a secure clamping without loosening the coupling members in a strong bouncing condition.

SUMMARY OF THE INVENTION

The primary object of the present invention is to provide an improved clamping fixture for bouncing apparatus to rapidly clamp a resilient stem without scraping, damaging or breaking the resilient stem.

Another object of the invention is to provide an improved clamping fixture that has two corresponding coupling members and mating anchor members on two ends of the resilient stem that are engageable to form rapid coupling so that the resilient stem does not loosen or fracture under strong bouncing condition of the bouncing apparatus.

To achieve the foregoing objects the clamping fixture of the invention includes two coupling members and two anchor members made from plastics that oppose each other. The coupling members have a first latch member and a second latch member that are engageable with each other to form a clamping space, and two anchor bosses extended outwards from another end that are engageable with the two anchor members. The two anchor members are hinged on two sides of the coupling members so that the resilient stem can be anchored rapidly on a bouncing apparatus.

In one aspect, the anchor bosses are formed on an outer side of the coupling members to be hinged on the anchor members to anchor the resilient stem on the bouncing apparatus. The plastic coupling members have an inner rim which is not as sharp as the conventional aluminum coupling members, thus do not scrape, damage or break the resilient stem during clamping. As a result the coupling members can form a secure coupling and achieve a longer durability.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
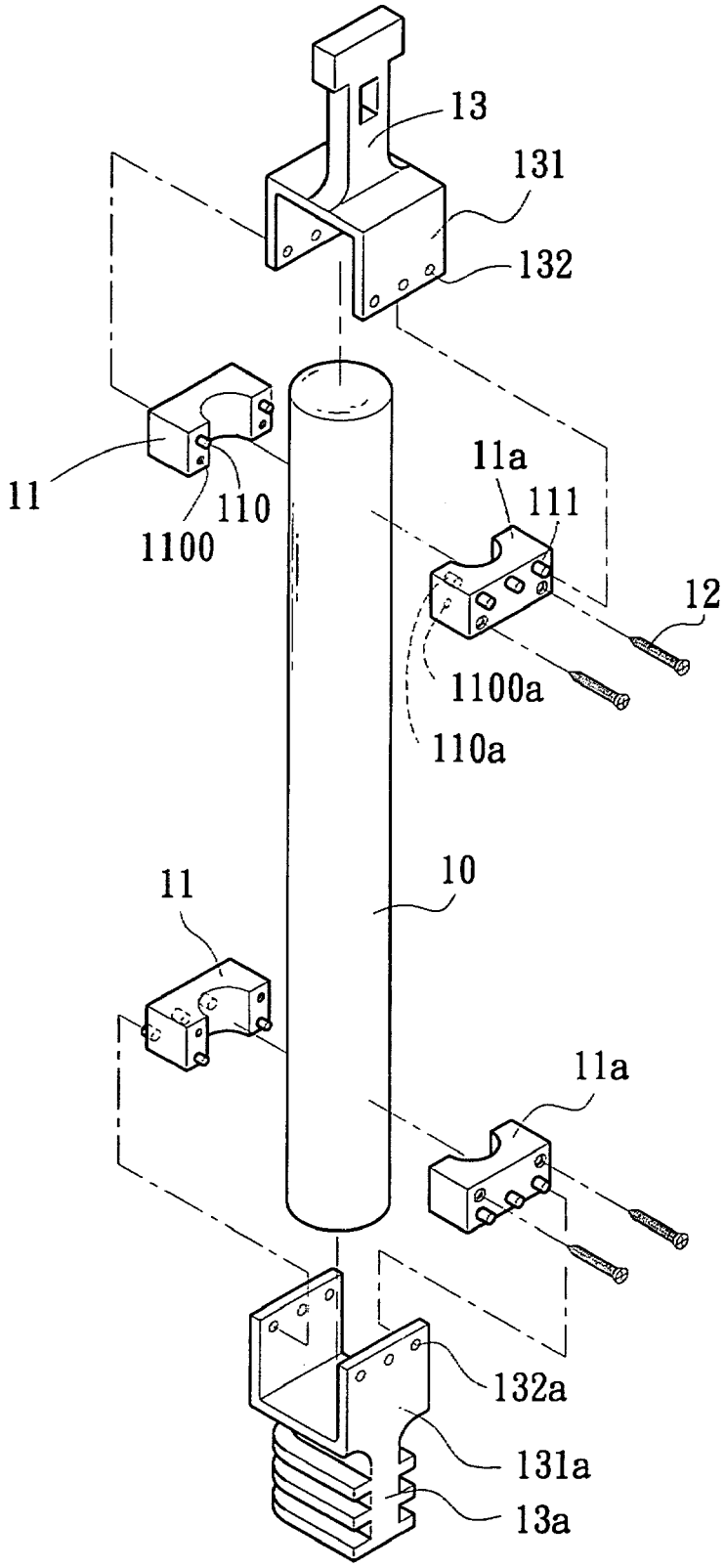
Fig. 1 PRIOR ART
FIG. 1 is an exploded view of a resilient means of a conventional bouncing apparatus.
Figure 2:
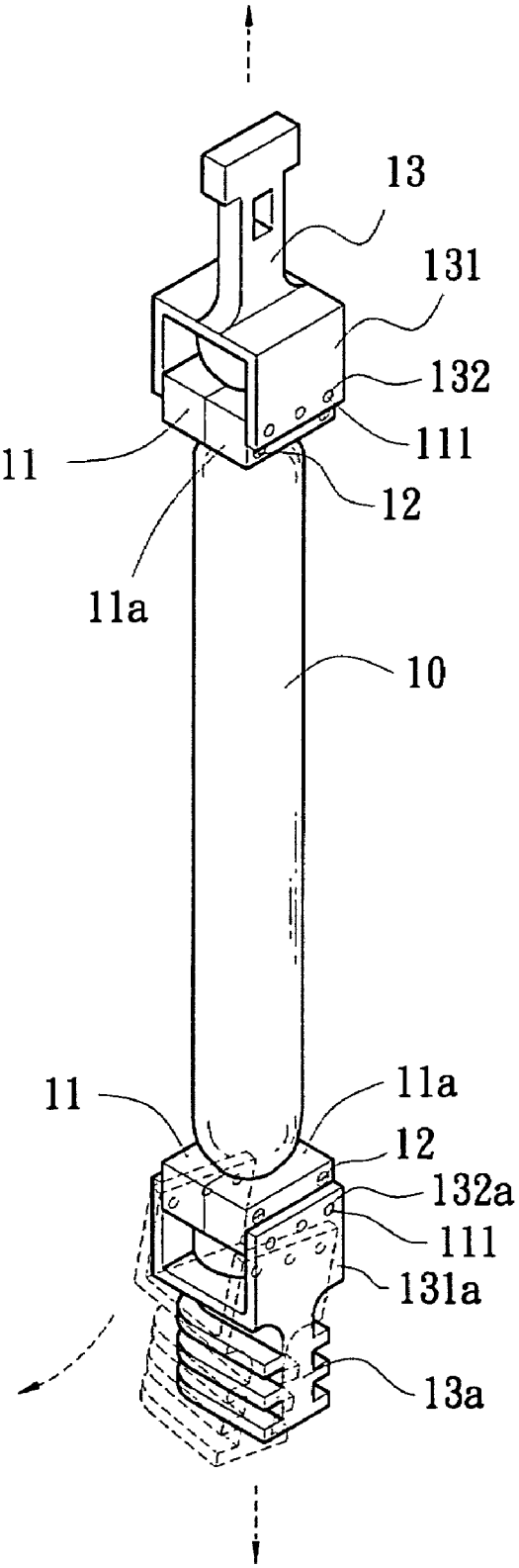
Fig. 2 PRIOR ART
FIG. 2 is a perspective view according to FIG. 1.
Figure 3:
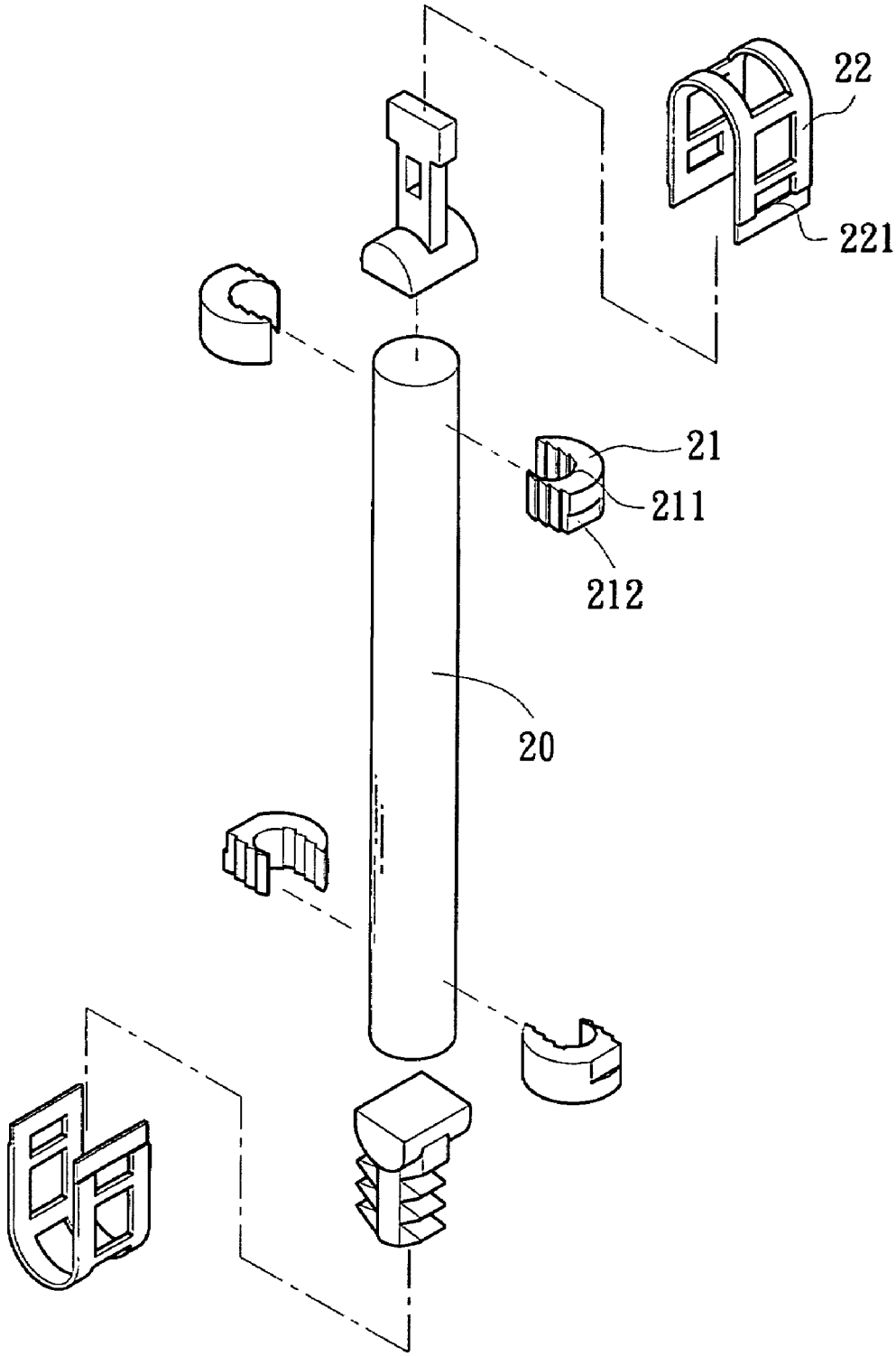
Fig. 3 PRIOR ART
FIG. 3 is an exploded view of a resilient means of another conventional bouncing apparatus.
Figure 4:
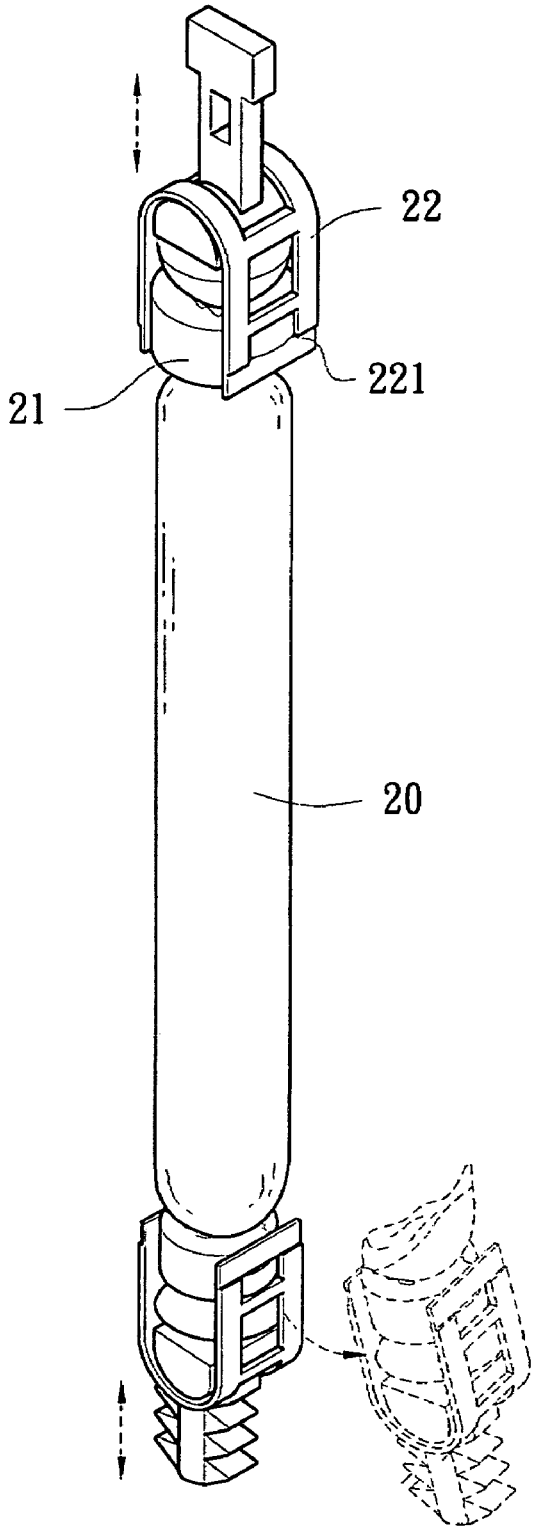
Fig. 4 PRIOR ART
FIG. 4 is a perspective view according to FIG. 3.
Figure 5:
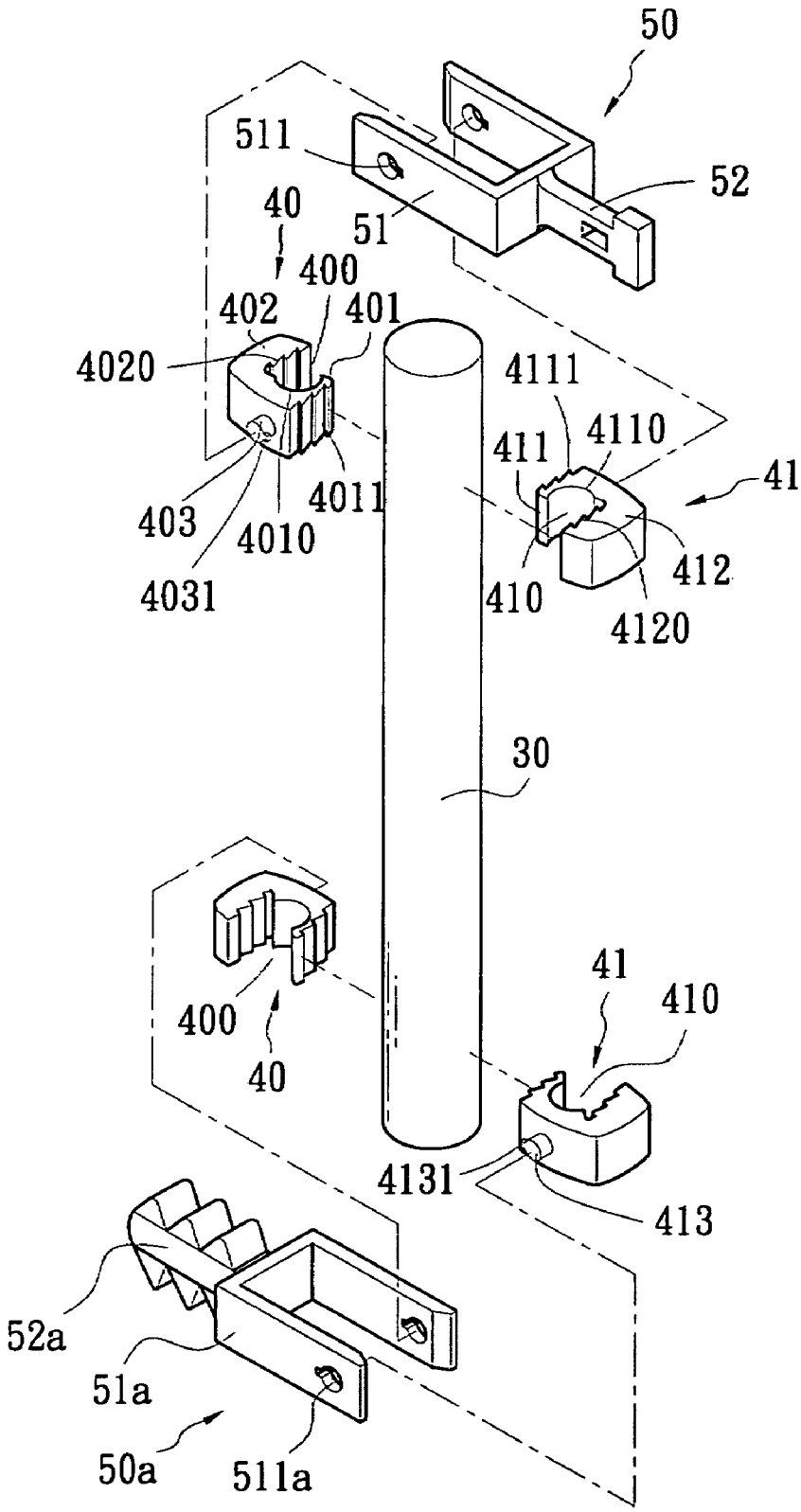
FIG. 5 is an exploded view of a resilient means of a bouncing apparatus according to the invention.
Figure 6:
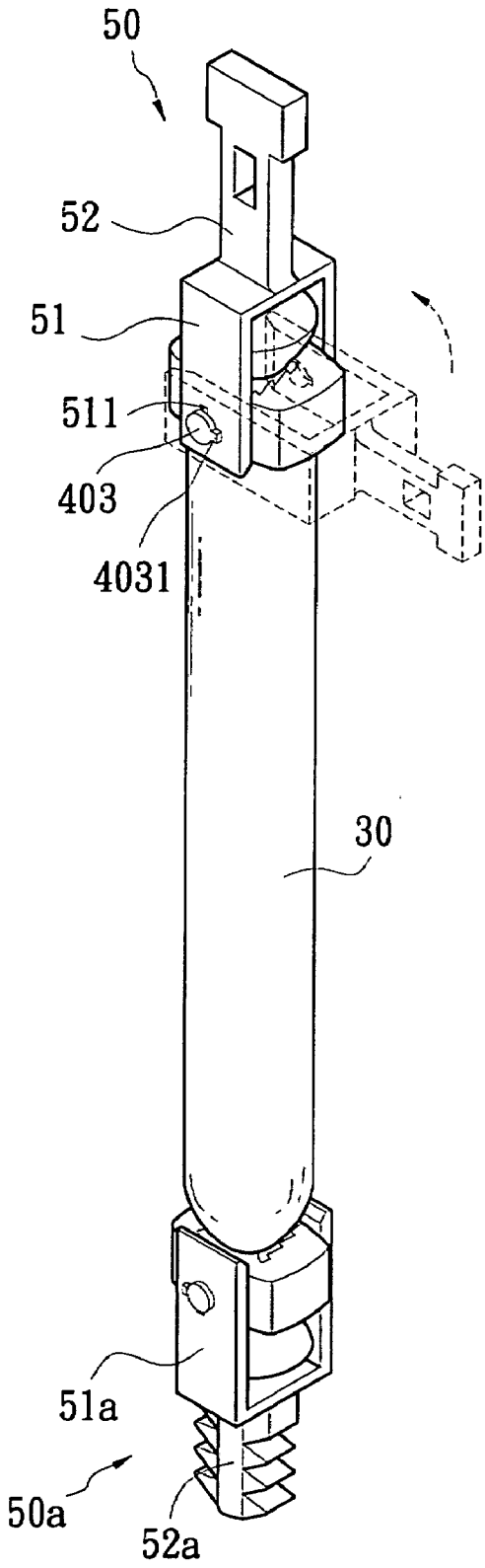
FIG. 6 is a perspective view according to FIG. 5.

Please refer to FIGS. 5 and 6, the clamping fixture according to the invention mainly includes two corresponding coupling members 40 and 41, and two anchor members 50 and 50*a*.

The coupling members 40 and 41 have respectively a first latch member 401 and 411 and a second latch member 402 and 412 that may be integrally formed and connected to each other. The first latch members 401 and 411 and the second latch members 402 and 412 are engageable to form respectively a clamping space 400 and 410. The coupling members 40 and 41 further have respectively an anchor boss 403 and 413 extended outwards from another side that are engageable with the anchor members 50*a* and 50*a*. The anchor bosses 403 and 413 form respectively a tenon 4031 and 4131 adjacent to one edge of the first latch members 401 and 411 that corresponding to and opposing each other.

The coupling members 40 and 41 are made from plastics, with the first latch members 401 and 411, second latch members 402 and 412, and clamping spaces 400 and 410 formed thereon, also form respectively a semi-circle 4010 and 4110 to mate a resilient stem 30 made from rubber. The second latch members 402 and 412 further have saw type latch troughs 4020 and 4120.

The first latch members 401 and 411 further have latch arms 4011 and 4111 on an outer side opposing the semi-circle 4010 and 4110 to form latch coupling with the latch troughs 4120 and 4020.

Referring to FIGS. 5 and 6, when in use, the latch arms 4011 and 4111 of the first latch members 40 and 41 are coupled with the latch troughs 4020 and 4120 of the second latch members 402 and 412 to clamp two ends of the resilient stem 30 in the semi-circle 4010 and 4110 formed by the clamping spaces 400 and 410. The anchor bosses 403 and 413 are hinged in mating coupling holes 511 and 511*a* formed on clamping ends 51 and 51*a* of the anchor members 50 and 50*a*. By turning the anchor members 50 and 50*a* to move the tenons 4031 and 4131 to be latched outside the coupling holes 511 and 511*a*, fastening portions 52 and 52*a* formed on another side of the anchor members 50 and 50*a* can be coupled with a coupling means of a bouncing apparatus 60 to form a desired anchoring condition (referring to FIG. 7).

By means of the construction set forth above, the plastic coupling members 40 and 41 can clamp two ends of the rubber resilient stem 30 with the two anchor members 50 and 50*a* coupling thereon to form the resilient means. As the coupling members 40 and 41 are made from plastics rather metal, they do not scrape or damage the resilient stem 30, or cause fractures at the clamping portion. Hence the two ends of the resilient stem 30 are more durable.

Figure 7:
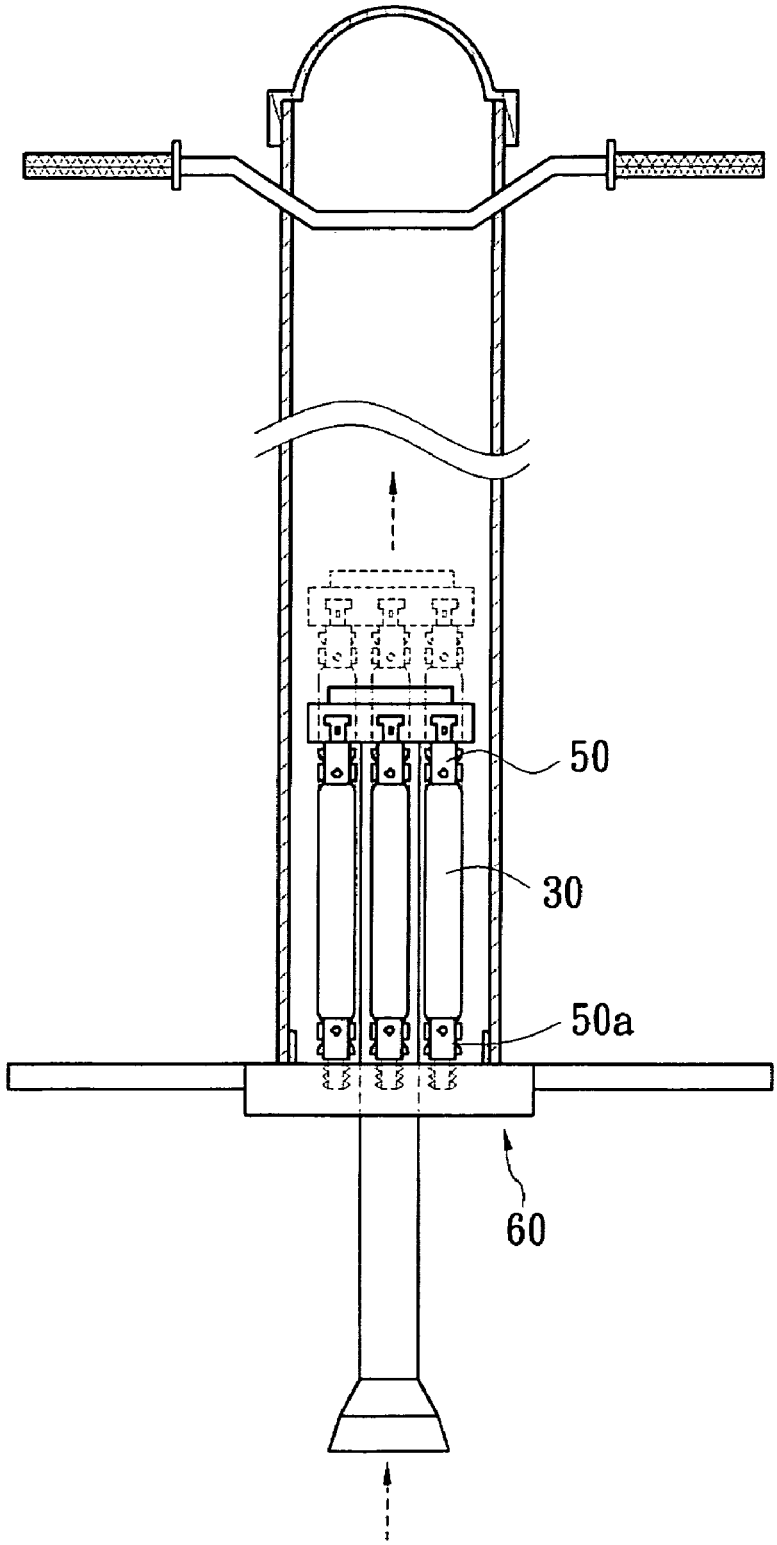
FIG. 7 is a schematic view of the present invention adopted on a bouncing apparatus in a bouncing condition.

In short, referring to FIGS. 6 and 7, the clamping fixture of the invention has plastic coupling members 40 and 41 to clamp two ends of the resilient stem 30, with the anchor bosses 403 and 413 of the coupling members hinged on the coupling holes 511 and 511*a* of the anchor members 50 and 50*a*, and tenons 4031 and 4131 latched outside the coupling holes 511 and 511*a*, the anchor members 50 and 50*a* can be positioned outside the coupling members 40 and 41. When the bouncing apparatus 60 is subject to a strong bouncing force, the coupling members 40 and 41 do not scrape, damage or fracture two ends of the resilient stem 30. With the coupling members 40 and 41, and anchor members 50 and 50*a* coupled on the two ends of the resilient stem 30, a secure positioning can be achieved without loosening or escaping even under a strong bouncing condition of the bouncing apparatus 60. Thus a greater safety can be achieved for users.

What is claimed is:

1. A clamping fixture for bouncing apparatus, comprising at least:

two corresponding coupling members which are made from plastics and have respectively a first latch member and a second latch member that form a clamping space between the first latch member and the second latch member, and an anchor boss extended outwards from the outer surface of the coupling members; and two anchor members having coupling holes to hinge the anchor bosses for positioning on two sides of the coupling members and a fastening portion on a lower end to be pivotally coupled with an upper end and a lower end of a bouncing apparatus.

2. The clamping fixture for bouncing apparatus of claim 1, wherein the second latch member has a saw-type latch trough.

3. The clamping fixture for bouncing apparatus of claim 1, wherein the first latch member has a saw-type latch arm on an outer side.

4. The clamping fixture for bouncing apparatus of claim 1, wherein the anchor boss has a corresponding tenon adjacent to the first latch member opposing each other.

5. The clamping fixture for bouncing apparatus of claim 1, wherein the fastening portion is formed in a desired shape engageable with a coupling means located on the upper end and the lower end of the bouncing apparatus.

* * * * *